US006065964A

United States Patent [19]

Pelissier

[11] Patent Number: 6,065,964

[45] Date of Patent: May 23, 2000

[54] MODULAR VACUUM THERMAL PROCESSING INSTALLATION

[75] Inventor: Laurent Pelissier, Saint Jean de Moirans, France

[73] Assignee: Etudes et Constructions Mecaniques, France

[21] Appl. No.: 09/204,379

[22] Filed: Dec. 2, 1998

[30] Foreign Application Priority Data

Dec. 2, 1997 [FR] France ..... 97 15506

[51] Int. Cl.[7] ..... F27B 9/02

[52] U.S. Cl. ..... 432/230; 432/11; 432/124; 432/207; 414/940

[58] Field of Search ..... 432/10, 11, 124, 432/207, 208, 230; 414/217, 679, 940

[56] References Cited

U.S. PATENT DOCUMENTS

| | | | |
|---|---|---|---|
| 4,430,055 | 2/1984 | Sugiyama | 432/11 |
| 5,052,923 | 10/1991 | Peter et al. | 432/207 |
| 5,076,205 | 12/1991 | Vowles et al. | 118/719 |
| 5,380,682 | 1/1995 | Edwards et al. | 437/225 |
| 5,549,473 | 8/1996 | Valentian | 432/10 |

FOREIGN PATENT DOCUMENTS

| | | |
|---|---|---|
| 2487492 | 1/1982 | France . |
| 2537260 | 6/1984 | France . |
| 2594102 | 8/1987 | France . |
| 243050A | 2/1987 | Germany . |
| 4442903 | 6/1996 | Germany . |

OTHER PUBLICATIONS

Egger, et al. "Multifumktionelle Warmebehandlungszentren fur die Flexible Gasaufkohlung", htm Harterei Technische Mitteilungen, vol. 49, No. 5, Sep. 5, 1994.

Copy of French Search Report for97/15506, dated Aug. 21, 1998.

*Primary Examiner*—Denise L. Ferensic
*Assistant Examiner*—Gregory A. Wilson
*Attorney, Agent, or Firm*—Arthur L. Plevy; Buchanan Ingersoll PC

[57] ABSTRACT

The present invention relates to a chained thermal processing installation under rarefied atmosphere including several processing cells linked in a horizontal plane to a common air-tight chamber provided with handling means for transferring a load from one cell to another. The common chamber is a cylinder with a horizontal axis, at least one end of which is arranged to receive a module in the form of a cylindrical extension to which additional cells are connected.

8 Claims, 2 Drawing Sheets

MODULAR VACUUM THERMAL PROCESSING INSTALLATION

BACKGROUND OF THE INVENTION

1. Field of the Invention

The present invention relates to a thermal processing installation under rarefied atmosphere including several processing cells linked to a common air-tight chamber provided with handling means for transferring a load from one cell to another.

2. Discussion of the Related Art

French patent application 2537260 describes such a thermal processing installation. The processing cells are arranged horizontally in a stellate fashion inside a cylindrical air-tight chamber having a vertical axis. The cells are serviced by a central handling device.

A disadvantage of known installations of this type is that the number of processing cells is fixed. There is no possibility of modifying the installation to make it have additional processing cells.

Another disadvantage of such installations is that it is particularly difficult to achieve maintenance operations inside the chamber, for example to adjust the handling device. Such an operation most often requires a complete or partial disassembly of the handling device.

SUMMARY OF THE INVENTION

An object of the present invention is to provide a chained thermal processing installation under rarefied atmosphere which can receive any number of processing cells.

Another object of the present invention is to provide such an installation which enables particularly easy maintenance operations inside the chamber.

These objects are achieved by means of a chained thermal processing installation under rarefied atmosphere including several processing cells linked in a horizontal plane to a common air-tight chamber provided with handling means for transferring a load from one cell to another. The common chamber is a cylinder with a horizontal axis, at least one end of which is arranged to receive a module in the form of a cylindrical extension to which additional cells are connected.

According to an embodiment of the present invention, at least one end of the cylinder is provided with a removable cover in place of which the module can be mounted.

According to an embodiment of the present invention, the handling means include a carriage moving in a direction parallel to the cylinder axis and servicing the cells by means of a telescopic element.

According to an embodiment of the present invention, one of the cells is an oil quenching cell also used as a loading/unloading cell.

According to an embodiment of the present invention, the carriage moves on rails attached to the chamber, these rails being prolonged in the module by rails attached to the module.

According to an embodiment of the present invention, the module is provided to be assembled by one end to the chamber and by the other end to another module.

According to an embodiment of the present invention, the module is open at both ends, the end which remains open after assembly of the module to the chamber receiving an additional module or the cover.

According to an embodiment of the present invention, the installation includes a gas quenching cell operating with nitrogen or a mixture comprising at least 50% of nitrogen.

The foregoing objects, features and advantages of the present invention will be discussed in detail in the following non-limiting description of specific embodiments in connection with the accompanying drawings.

DETAILED DESCRIPTION

To be able to use any number of processing cells in a chained thermal processing installation, the present invention provides a modular installation. The modularity is made possible by a specific structure of the installation.

Figure 1:
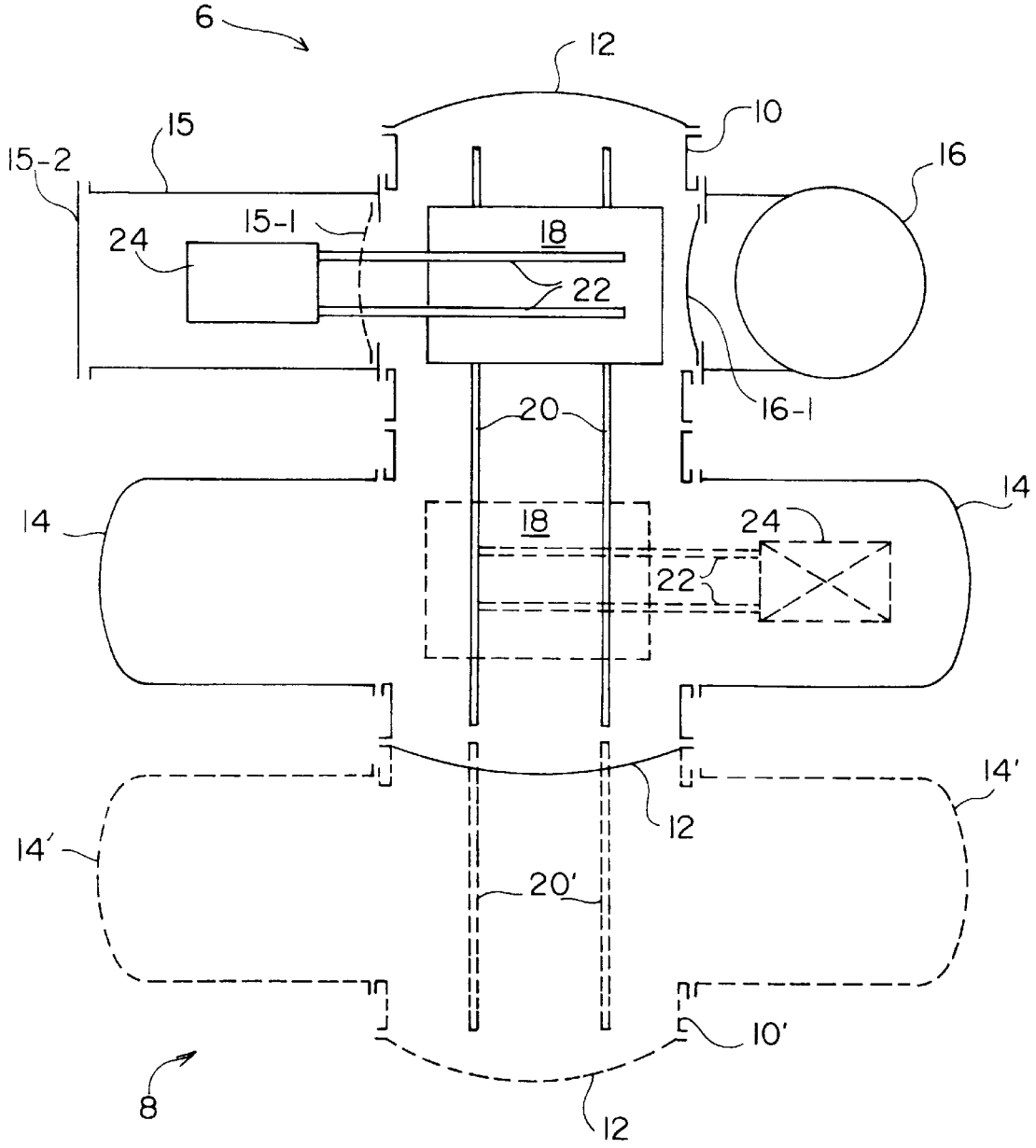
FIG. 1 schematically shows a top view of a chained thermal processing installation according to the present invention.

FIG. 1 illustrates a basic module 6 of an installation according to the present invention and in dotted lines an additional module 8.

Basic module 6 includes an air-tight chamber 10 in the form of a cylinder of horizontal axis. Both ends of cylinder 10, provided with flanges, are closed by removable air-tight covers 12. The processing cells are laterally connected to cylinder 10 and are located in a same horizontal plane. As an example, FIG. 1 illustrates two thermal processing cells 14 arranged facing each other, a loading/unloading cell 15, and a gas quenching cell 16 arranged facing the loading/unloading cell 15.

Figure 2:
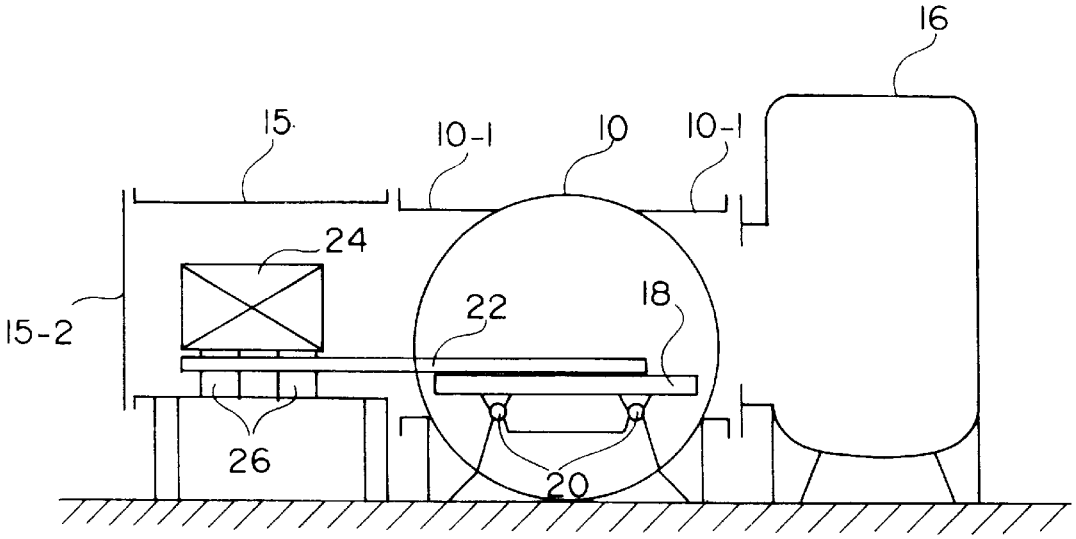
FIG. 2 very schematically shows a side cross-section view of the installation of FIG. 1.

As can be better seen in FIG. 2, cylindrical chamber 10 includes lateral cylindrical extensions 10-1 provided with flanges enabling the tight attachment of the processing cells, for example, by means of bolts.

Conventionally, the openings for communication of thermal processing cells 14 with chamber 10 are provided with doors (not shown) which are heat insulating but not air-tight. Indeed, the pressure which is created in chamber 10, on the order of 5 millibars, is that which must be present in processing cells 14. Conversely, loading/unloading cell 15 and gas quenching cell 16 are provided with air-tight doors, respectively 15-1 and 16-1, at their openings for communication with chamber 10. Indeed, loading/unloading cell 15 includes an outer door 15-2 for inserting the loads to be processed into the installation. It must thus be possible to submit cell 15 to the atmospheric pressure without disturbing the atmosphere of chamber 10. Similarly, a pressure higher than the atmospheric pressure is present in cell 16 during quenching operations.

A handling device is in the form of a carriage 18 moving in a direction parallel to the axis of cylinder 10. Carriage 18 moves, for example, on rails 20 extending along the entire length of cylinder 10. Carriage 18 is provided with a telescopic fork 22 which can extend on either side of carriage 18 to the centers of cells 14 to 16 to pick up and deposit a load being processed.

In FIG. 1, carriage 18 is located at the level of cells 15 and 16, and telescopic fork 22 penetrates into cell 15 to pick up a load 24. Of course, cell 15 has previously been submitted to the pressure of chamber 10 to allow door 15-1 to open. As shown in FIG. 2, load 24 is laid on supports 26 elevating load 24 with respect to the bottom of the cell and enabling fork 22 to pass under the load. Fork 22 is raised to lift up load 24 from supports 26, then drawn back to bring load 24 onto carriage 18. Then, carriage 18 moves in front of the desired cell, for example, to the position shown in dotted lines. Fork 22 is then drawn out and lowered to deposit load 24 in the cell.

In the basic installation of FIG. 1 (shown in full line), the two cells 14 are, for example, carburizing cells, which will enable the processing of two loads 24 practically at the same time. The single quenching cell 16 will suffice since the quenching operation is particularly fast as compared to carburizing operations.

If the yield of the installation should be increased or if it is desired to perform other processings, additional processing cells are required. In this case, a module 8 shown in dotted lines in FIG. 1 is assembled to the basic installation. Module 8 includes a cylindrical portion 10' which is assembled in the continuity of cylindrical chamber 10 in place of one of covers 12. The removed cover 12 may be used to close the free end of cylindrical portion 10'. Module 8 may be comprised, as shown, of only two additional cells 14' connected facing each other to cylindrical portion 10'.

Of course, additional modules may be assembled to the free ends of module 8 and basic module 6 in place of covers 12. Several modules may thus be assembled in cascade to create a thermal processing installation adapted to the user's needs.

In the case where carriage 18 is mounted on rails 20, as shown, module 8 may include rails 20' which connect to rails 20 when module 8 is assembled to the basic installation.

To operate in chamber 10 or 10', it is sufficient to remove one or both covers 12, which opens a corridor enabling a person to penetrate into the installation and to easily perform the necessary operations on handling device 18, 22, and on the cells. In case of need, the handling device is moved to one side or the other of the chamber.

As shown in FIG. 2, the installation may include a loading/unloading cell 15 and a gas quenching cell 16. A gas quenching is appropriate for a great number of materials. To obtain the right compromise between the power required to stir the hardening gas and the variety of the materials which can be gas-quenched, nitrogen or a mixture containing at least 50% of nitrogen is used.

Nevertheless, some materials require an oil quenching.

Figure 3:
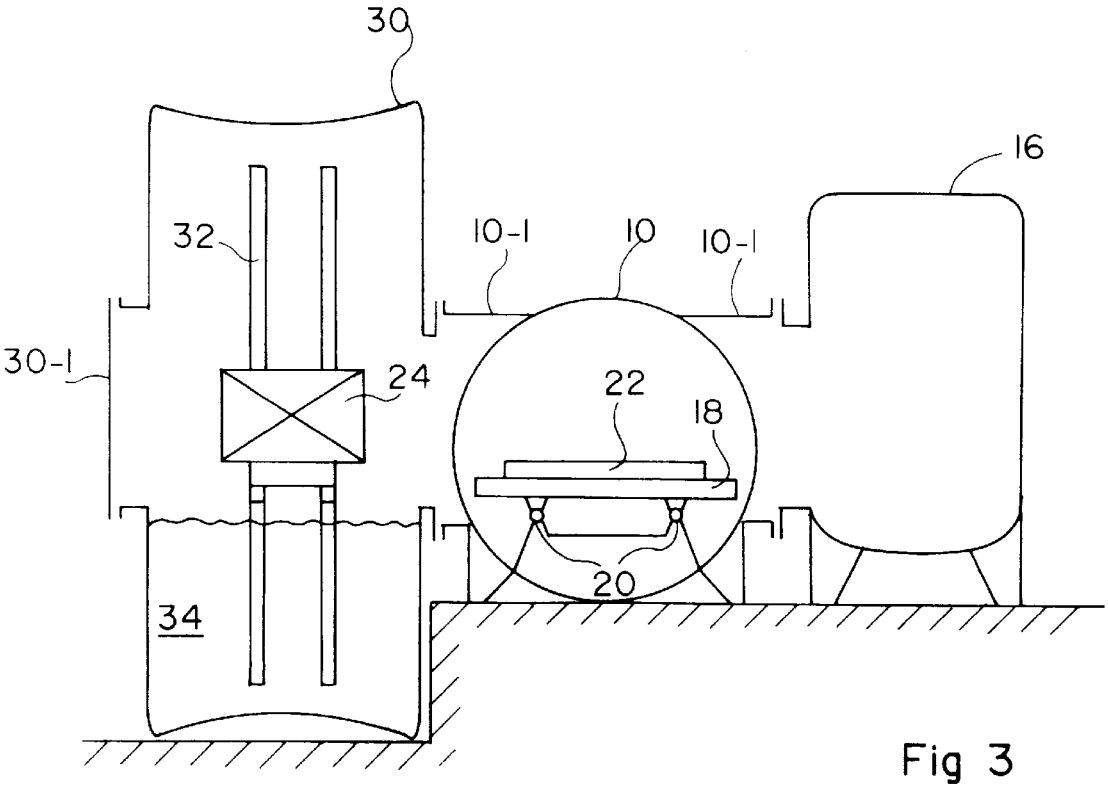
FIG. 3 shows a side cross-section view of an alternative of the installation of FIG. 1.

FIG. 3 shows a side cross-section view of an installation of the type of FIG. 1, comprising an oil quenching cell 30. Cell 30 may advantageously replace loading/unloading cell 15 of FIGS. 1 and 2. Oil quenching cell 30 then comprises an outer door 30-1 used to extract and introduce loads 24 in the installation. Cell 30 further includes an elevator 32 enabling maintaining the load at a height adapted to handling device 18, 22 and to immerge load 24 in an oil bath 34.

This disposition is advantageous because, since the quenching operation is the last one, the processed load 24 may directly be extracted, which cancels the time of travel from a quenching cell to the loading/unloading cell. The additional cost of a dedicated loading/unloading cell is also avoided.

Of course, oil quenching cell 30 is provided, like loading/unloading cell 15, with an air-tight door (not shown) meant to isolate it from chamber 10 to enable loading/unloading operations at atmospheric pressure without affecting the pressure present in chamber 10.

Handling device 18, 22 is driven by conventional means. For example, carriage 18 may move along rails 20 by means of an integrated electric motor provided with a pinion which is in mesh with a rack arranged in a direction parallel to the rails. Telescopic fork 22 may be extended and retracted by a chain or lever system. The raising and lowering of the fork may be obtained by a cam or eccentric system.

Of course, the present invention is likely to have various alterations, modifications, and improvements which will readily occur to those skilled in the art. Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A chained thermal processing installation under rarefied atmosphere including several processing cells linked in a horizontal plane to a common air-tight chamber provided with handling means for transferring a load from one cell to another, wherein the common chamber is a cylinder with a horizontal axis at least one end of which is arranged to receive a module in the form of a cylindrical extension to which additional cells are connected.

2. The thermal processing installation of claim 1, wherein at least one end of the cylinder is provided with a removable cover in place of which the module can be mounted.

3. The thermal processing installation of claim 2, wherein the module is open at both ends, the end which remains open after assembly to the module to the chamber receiving an additional module or the cover.

4. The thermal processing installation of claim 1, wherein the handling means include a carriage moving in a direction parallel to the cylinder axis and servicing the cells by means of a telescopic element.

5. The thermal processing installation of claim 1, wherein one of the cells is an oil quenching cell also used as a loading/unloading cell.

6. The thermal processing installation of claim 1, wherein the carriage moves on rails attached to the chamber , these rails being prolonged in the module by rails attached to the module.

7. The thermal processing installation of claim 1, wherein the module is provided to be assembled by one end to the chamber and by the other end to another module.

8. A chained thermal processing installation under rarefied atmosphere comprising several processing cells linked in a horizontal plane to a common air-tight chamber including handling means for transferring a load from one cell to another, wherein said common chamber is a cylinder having a horizontal axis, at least one end of said cylinder is arranged to receive a module in the form of a cylindrical extension to which additional cells are connected, and one of said cells is a gas quenching cell operating with nitrogen or a mixture comprising at least 50% of nitrogen.

* * * * *